US005669787A

United States Patent [19]

Miyazawa

[11] Patent Number: 5,669,787

[45] Date of Patent: Sep. 23, 1997

[54] SHUNT CONNECTOR ASSEMBLY

[75] Inventor: Junichi Miyazawa, Yokohama, Japan

[73] Assignee: Molex Incorporated, Lisle, Ill.

[21] Appl. No.: 689,436

[22] Filed: Aug. 9, 1996

Related U.S. Application Data

[63] Continuation of Ser. No. 511,674, Aug. 7, 1995.

[51] Int. Cl.[6] ..... H01R 31/08

[52] U.S. Cl. ..... 439/510

[58] Field of Search ..... 439/510, 507, 439/512, 513, 746, 748

[56] References Cited

U.S. PATENT DOCUMENTS

| | | | |
|---|---|---|---|
| 4,954,093 | 9/1990 | Nadin | 439/512 |
| 5,169,337 | 12/1992 | Ortega et al. | 439/510 |
| 5,281,165 | 1/1994 | McCleerey et al. | 439/510 |

*Primary Examiner*—Neil Abrams
*Assistant Examiner*—Barry Matthew L. Standig
*Attorney, Agent, or Firm*—Stacey E. Caldwell

[57] ABSTRACT

A miniaturized shunt connector assembly provides sufficient retention force between the assembly and mating contact posts and includes an insulative housing defining a contact-receiving cavity and a contact mounted therewithin. The contact includes an opposing pair of generally opposing support pieces including parallel arm supporting portions spaced a given dimension apart. Resilient contact arms extend from an upper edge of each arm supporting portion and are inwardly and downwardly formed to project beyond the lower edge thereof. An anchor portion extends from a lower portion of each support piece and connects to an adjacent portion of the other of the pair of support pieces. One resilient contact arm opposes a corresponding resilient contact arm inside respective arm supporting portions and maintains a spaced apart dimension smaller than the dimension of the parallel arm supporting portions. The connector assembly is used to electrically couple or short two adjacent contact pins, and may be formed with contact portions generally equidistant from the top and bottom surfaces of the housing, thus obviating the need for orienting the housing.

11 Claims, 4 Drawing Sheets

FIG. 1
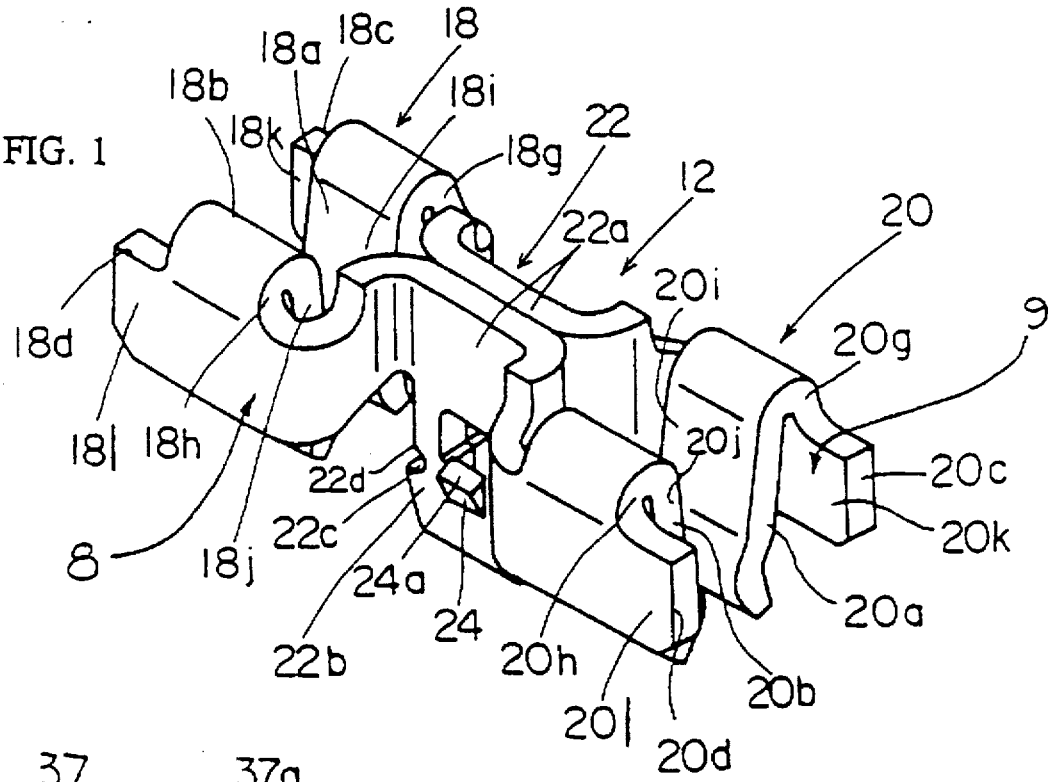
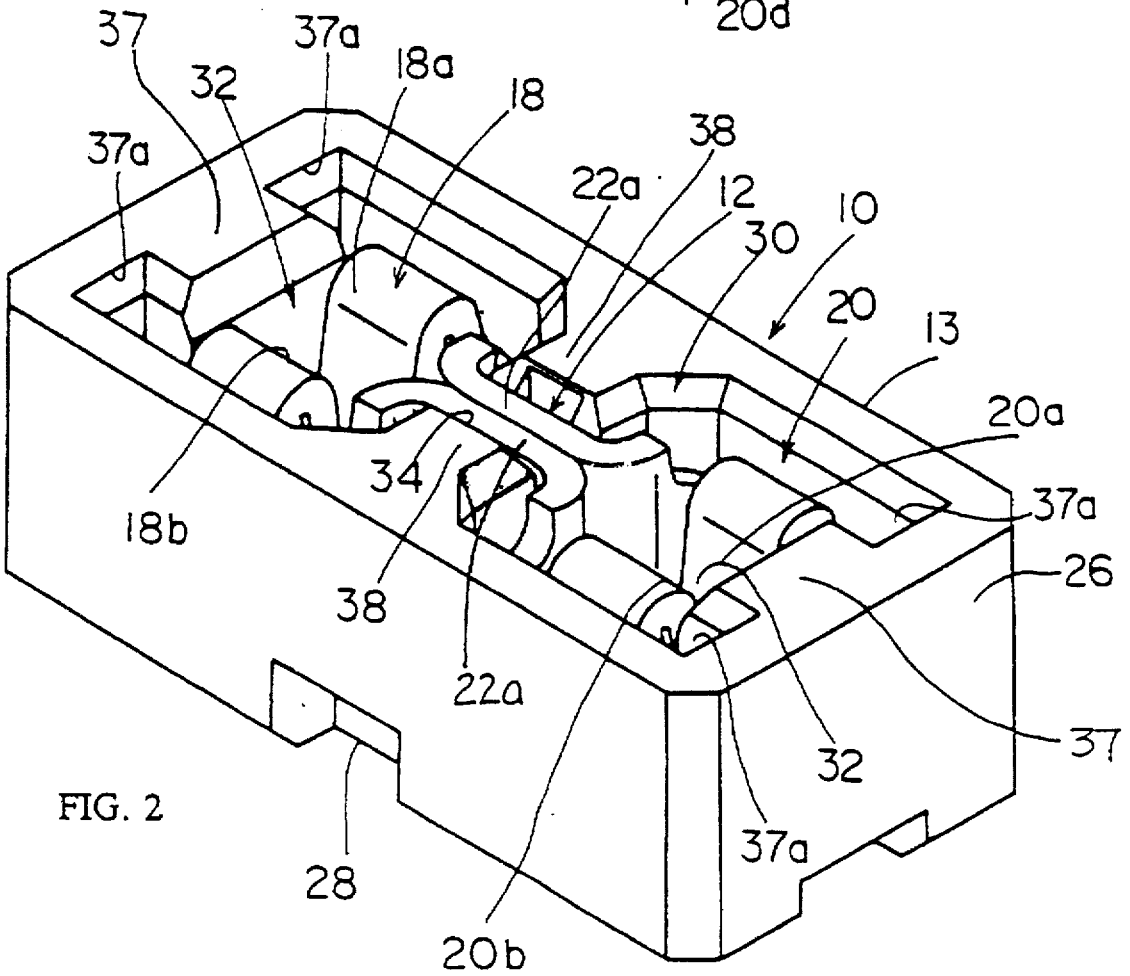
FIG. 2

PRIOR ART

SHUNT CONNECTOR ASSEMBLY

This is a continuation of application Ser. No. 08/511,674, filed Aug. 7, 1995.

FIELD OF THE INVENTION

The present invention relates generally to a shunt connector assembly for electrically shorting adjacent contact posts on a printed circuit board. More specifically, the invention relates to a low profile miniaturized shunt connector assembly which maintains sufficient retention force between adjacent post contacts and the shunt assembly terminals.

BACKGROUND OF THE INVENTION

As miniaturization of electronic equipment and associated printed circuit boards continues, there is an increasing demand for corresponding low profile connector assemblies for mounting on the printed circuit boards. Space and density become so valuable that even a small two circuit shunt connector assembly for electrically shorting an adjacent pair of post contacts must be down-sized or miniaturized, along with the down-sizing of the printed circuit board. To miniaturize a typical connector assembly, there must be a reduction in the overall height of the housing and a corresponding reduction in the height of a terminal which consequently reduces the effective beam length of the contact arms of the terminal. This, in turn, results in a decreased amount of resilient deformation of the contact which may cause plastic deformation in the housing portion in engagement with the post contact. Therefore, such a miniaturization could potentially cause instability in the electrical connector. Furthermore, in the miniaturization of a shunt connector assembly, since such a connector is designed to resiliently couple two adjacent post contacts and maintain engagement by way of frictional forces, when the shunt connector assembly is miniaturized, the frictional or engagement forces become smaller due to the shortening of the effective beam length of the contact arm therefore making it difficult to maintain sufficient retention force between the post contact and the shunt connector assembly terminals and compromising the mechanical and electrical interconnection therebetween.

FIG. 9 shows a shunt connector assembly as disclosed in Japanese Unexamined Utility Model Publication (Kokai) No. Heisei 5-62994.

As shown in FIG. 9, a shunt connector contact 1 is adapted to be mounted within a contact receiving cavity of an insulative housing. Post holding portions 2, 3 are formed adjacent one another along an internal peripheral surface of the contact, and opposing respective pairs of resilient arms 4, 5 are positioned adjacent an insertion opening at both lateral sides of each holding portion. A bridge portion 6 connects front and rear walls of the holding portions at the center thereof. The post holding portions 2, 3, the resilient arms 4, 5 and the bridge portion 6 are integrally formed from a single conductive element so that when the shunt connector engages the post contacts, a reactive force causes some inward deformation of the post holding portions opposite the insertion opening due to an outward force exerted on the resilient arms by the post contacts. As a result, electrical contact is made between the shunt connector assembly and the post contacts due to this deformation.

In the prior art set forth above, the miniaturization of the shunt connector assembly is achieved by the reduction of the actual length or height of the resilient arms of the post holding portions, thereby effecting an overall reduction in the retention forces between the resilient arms of the shunt connector and the post contacts. The retention force that is present between the shunt assembly and the post contacts is due to the integral construction of the contact and, in particular, the closed configuration of the holding portion. However, this construction cannot compensate for the reduction in resilient deformation due to the shorter effective beam length of the resilient arms. Furthermore, bridge portion 6 is unitary and therefore is prevented itself from being resiliently deformed upon insertion of the post contact. This may cause eventual inelastic deformation of the resilient arms together with a consequent reduction of the spring characteristics of the contact and loss of retention between the shunt assembly and the post contacts altogether.

SUMMARY OF THE INVENTION

Therefore, it is an object of the present invention to provide a low profile shunt connector which has contact arms with sufficient effective beam length to maintain a adequate retention force between the shunt connector terminals and the mating post contacts.

In order to accomplish the above-mentioned and other objects, a shunt connector assembly, according to the present invention, includes an insulative housing defining a contact-receiving cavity and a contact of a resilient conductive metal mounted within the contact-receiving cavity. The contact comprises:

a pair of generally opposing support pieces extending in a longitudinal direction;

generally parallel resilient arm supporting portions on each opposite end of each of the pair of opposing support pieces, and spaced a given dimension apart;

resilient arms inwardly and downwardly formed from an upper edge of each arm supporting portion and extending a given distance beyond the lower edge thereof; and an anchor portion extending from a portion of each support piece and integrally connected to an adjacent portion of the other of the pair of opposed support pieces;

wherein the resilient arms from one of the arm supporting portions are generally opposite the resilient arms of the other of the arm supporting portions and extend inside the arm supporting portions such that the opposing resilient arms maintain a dimension smaller than the dimension of the corresponding parallel arm supporting portions.

The support pieces include a bridge portion at a central portion thereof from which the anchor portion extends. The housing includes projections extending in a width direction toward the outside surface of the bridge portions to prevent outward deformation thereof. The bridge portion includes an engaging portion for engaging corresponding shoulders in the housing to ensure the retention of the contact within the contact-receiving cavity.

BRIEF DESCRIPTION OF THE DRAWINGS

The present invention will be understood more fully from the detailed description given hereinafter and from the accompanying drawings of the present invention, which should not be taken to limit the present invention, but are for explanation and understanding only.

In the drawings:

FIG. 1 is a perspective view of a contact to be employed in a shunt connector assembly according to the present invention;

FIG. 2 is a perspective view of the shunt connector assembly which is assembled by mounting the contact of FIG. 1 within an insulative housing;

DETAILED DESCRIPTION OF THE PREFERRED EMBODIMENT

Figure 8:
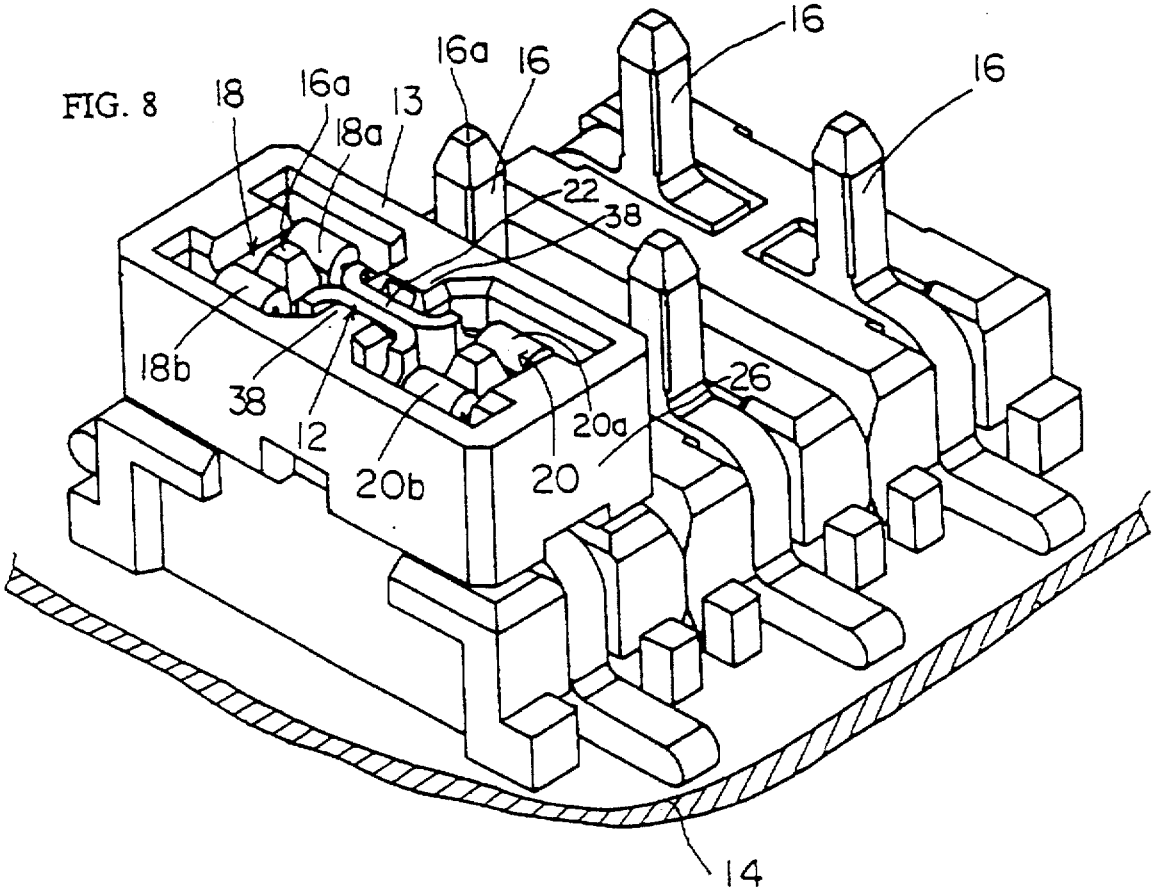
FIG. 8 is a perspective view of the shunt connector assembly shown in mating engagement with post contacts on a printed circuit board.
Figure 9:
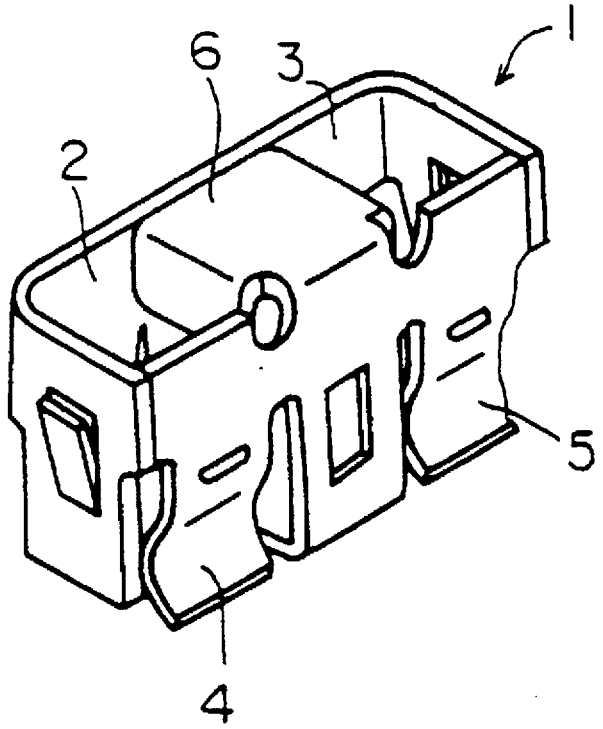
FIG. 9 is a perspective view of a prior art shunt connector assembly.

FIG. 1 shows a contact 12 employed in a shunt connector assembly 10 according to the present invention, and FIG. 2 shows the contact of FIG. 1 mounted within an insulative housing 13. As shown in FIG. 1, the contact 12 includes a pair of generally parallel longitudinally extending support pieces 8 and 9 which have contact engaging portions 18 and 20 at both longitudinal ends for engaging two adjacent post contacts 16 mounted on a printed circuit board 14 (see FIG. 8). The contact engaging portions 18 and 20 are connected to each other by a bridge portion 22. Contact engaging portion 18 has opposed resilient arms 18*a* and 18*b* extending from arm supporting portions 18*c* and 18*d*, respectively, which extend from bridge portion 22 in cantilever fashion and which are spaced for receiving chamfered head portion 16*a* of contact post 16 (FIG. 8). Similarly, contact engaging portion 20 has opposed resilient arms 20*a* and 20*b* supported by arm supporting portions 20*c* and 20*d*, respectively, which extend in cantilever fashion from bridge portion 22 and which are spaced for receiving chamfered head portion 16*a* of contact post 16. On bridge portion 22, a locking lance 24 extends outwardly along the lower edge of a rectangular hole for locking the contact within insulative housing 13.

As can be seen in FIG. 1, resilient contact arms 18*a*, 18*b*, 20*a* and 20*b* are constructed with curved or radiused portions 18*g*, 18*h* and 20*g*, 20*h*, connected to arm supporting portions 18*c*, 18*d* and 20*c*, 20*d* and downwardly extending arm portions 18*i*, 18*j* and 20*i*, 20*j* connected to the radiused portions.

Bridge portion 22 has opposing upper portions 22*a* continuous with arm supporting portions 18*c*, 18*d* and 20*c*, 20*d*, and an anchor portion 22*b* connecting the upper portions 22*a* and bent into a generally U-shaped configuration. Along a portion of the U-shaped anchor portion 22*b*, cut-outs 22*c* and shoulders 22*d*, extending from the lower edge of the cut-outs, are formed.

Figure 5:
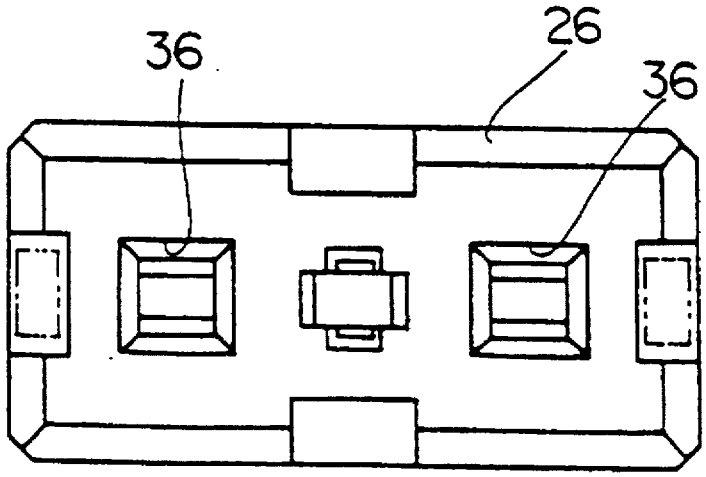
FIG. 5 is a bottom view of the shunt connector assembly of FIG. 2.
Figure 6:
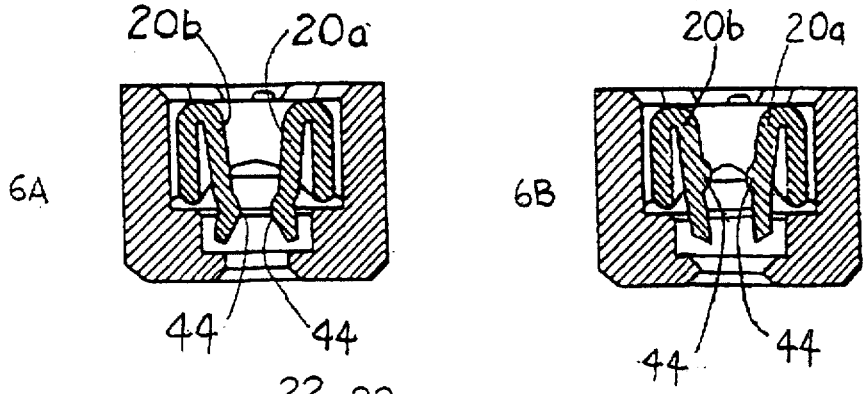
FIGS. 6A and 6B are sections of two embodiments of the shunt connector assembly taken generally along line 6—6 of FIG. 4.

Looking now to FIG. 2, contact 12 is mounted within insulative housing 13 which has a substantially rectangular configuration with an outer peripheral wall 26 and a bottom wall 28. Contact-receiving space 30 is surrounded by the outer peripheral wall 26 and the bottom wall 28. The contact-receiving space 30 includes two arm-receiving cavities 32 and a channel 34 for receiving bridge portion 22. The bottom wall 28 is formed with a through hole 36 (FIGS. 5–6), through which the mating post contact enters, and projecting portions 28*a* as described below.

At a generally central location between the arm-receiving cavities, housing projections 38 extend inwardly toward one another. The inner surfaces of the projections 38 are generally parallel and maintain a given dimension therebetween corresponding to the material thickness of the two opposing upper portions 22*a* of bridge portion 22.

Figure 3:
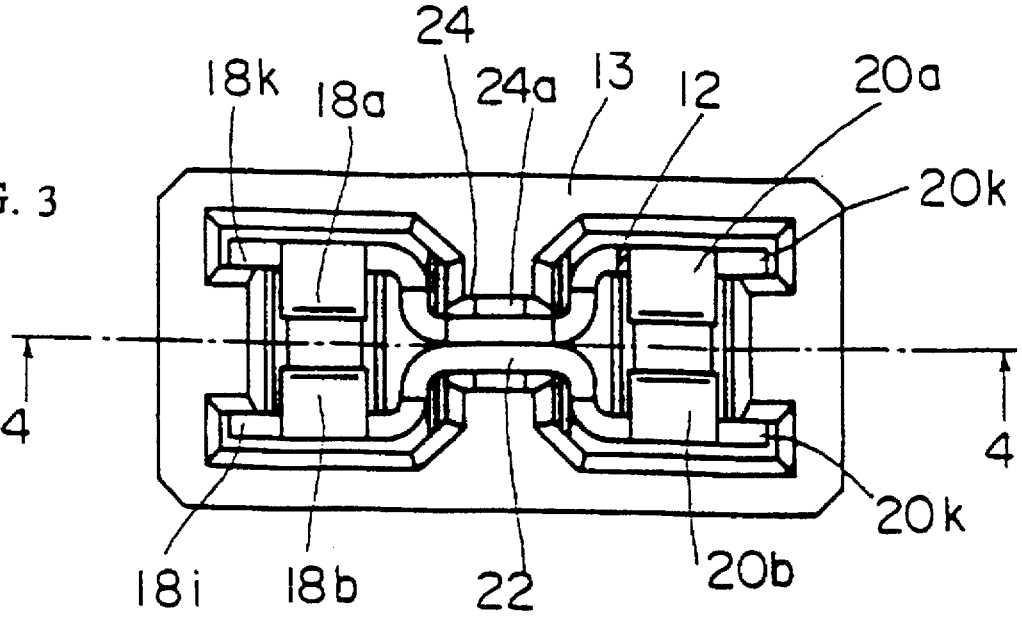
FIG. 3 is a plan view of the shunt connector assembly of FIG. 2.
Figure 4:
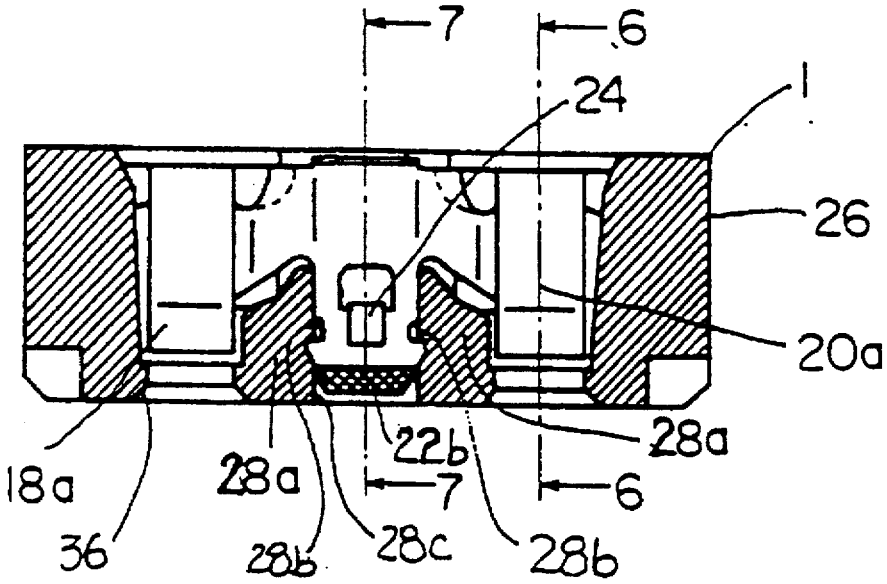
FIG. 4 is a section of the shunt connector assembly taken generally along line 4—4 of FIG. 3.
Figure 7:
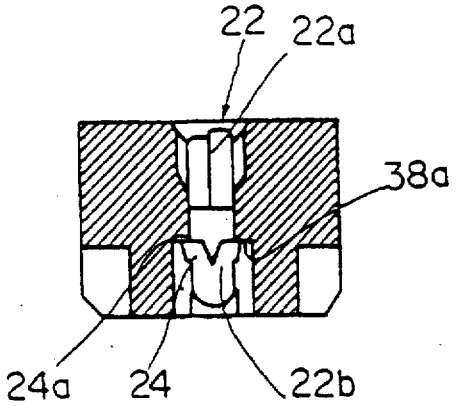
FIG. 7 is a section of the shunt connector assembly taken generally along line 7—7 of FIG. 4.

Looking now to FIG. 4, projecting portions 28*a* and downward shoulders 28*b* of floor 28 engage shoulders 22*d* of bridge portion 22 to restrict upward movement of contact 12. Furthermore, the vertical edge 28*c* of projecting portions 28*a* engage the side surfaces of anchor portion 22*b* to restrict movement of the contact 12 in a lateral direction. Also, upper edge 24*a* of lance 24 engages projecting shoulders 38*a* on the lower surface of each projection 38, as shown in FIG. 7, to restrict movement of the contact 12 in the upward direction. Finally, vertical surfaces of projections 38 contact opposing vertical surfaces of upper portions 22*a* of bridge portion 22 to restrict movement of contact 12 in the lateral direction and to restrict the outward resilient deformation of bridge portion 22.

Looking again to housing 13 in FIG. 2, longitudinally projecting portions 37 extend inwardly along a longitudinal axis from both ends thereof. The width or lateral dimension of projecting portion 37 is selected to correspond to the distance between the inner surfaces of opposing arm supporting portions 18*c* and 18*d*, and 20*c* and 20*d*. At both sides of the projecting portions 37, grooves 37*a* are formed for receiving respective ends 18*k*, 18*l* and 20*k*, 20*l* of arm supporting portions 18*c*, 18*d* and 20*c*, 20*d*, respectively.

With the construction described above, contact 12 is mounted securely within housing 13 such that movement of the contact in any direction is minimized.

Looking back to FIG. 1 with reference to FIGS. 6A and 6B, it can be seen that each resilient arm 18*a*, 18*b*, 20*a* and 20*b* of the contact is formed once toward an opposing arm, and formed again at a position slightly spaced from the arm supporting portions. Therefore, sufficient beam length is maintained to prevent plastic deformation of the resilient arms. To assure engagement with the post contacts, a rounded contact portion 44 is formed on each resilient arm, the position of which contact portion provides a force adequate for retaining the contact on the post contact, but does not cause plastic deformation or take a set. Also, with the resilient arm constructed as set forth above, the total force of the contact includes both the spring force of the material and the resilient force created by forming the arm and therefore assures sufficient retention force between the shunt connector assembly and the post contact. FIG. 6A shows a first embodiment of the shunt connector assembly showing the location of rounded contact portions 44 along resilient arms 20*a* and 20*b* and near a distal end thereof. FIG. 6B shows a second embodiment of the shunt connector assembly showing the location of rounded contact portions 44 along resilient arms 20*a* and 20*b* approximately midway along the resilient arm and therefore the same distance from the top and the bottom surfaces of the housing. This second embodiment allows placement of the shunt assembly on the contact posts without first orienting the housing, i.e. making the connector assembly more "user friendly".

Furthermore, according to the present invention, since the upper portions of the bridge are in contact, and since the contact is manufactured from a single integrally formed piece of metal, an additional opposing force in the resilient arms is generated and transferred back to the contact posts due to the force applied at the bridge portion during the initial deformation during insertion of the post contacts into the shunt assembly. This reactive or opposing force is propagated to the resilient arm and as a result, the frictional forces between the shunt assembly contact arms and the post contact are increased to correspondingly increase the retention forces of the connector assembly on the post contacts.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

We claim:

1. A shunt connector assembly including an insulative housing defining a contact-receiving cavity and a contact of a resilient metal received and fixed within the contact-receiving cavity, said contact comprising:

a pair of generally opposing support pieces extending in a longitudinal direction;

resilient arm supporting portions on each opposite end of each of the pair of opposing support pieces, and spaced a given dimension apart, a pair of resilient arms extending inwardly from an upper edge of each arm supporting portion and projecting downwardly beyond the lower edge of each arm supporting portion; and an anchor portion extending from a portion of each support piece and integral with an adjacent portion of the other of the pair of support pieces;

wherein each resilient arm is opposite a resilient arm from the opposing arm supporting portion and is spaced apart a dimension less than the dimension of the parallel arm supporting portions.

2. A shunt connector assembly as set forth in claim 1, further comprising a bridge portion connecting the resilient arm supporting portions, wherein said bridge portion includes upper portions in contact with one another.

3. A shunt connector assembly as set forth in claim 2, wherein said housing has lateral projections which extend toward the upper portions of the bridge portion for preventing outward deformation of said bridge portion.

4. A shunt connector assembly as set forth in claim 3, wherein said upper portions of said bridge portion is continuous with said anchor portion, and wherein the anchor portion includes a lance for securing the contact within the housing.

5. A low profile shunt connector assembly for engaging adjacent mating post contacts comprising:

an insulative housing defining a contact-receiving cavity;

an integrally formed conductive shunt contact received and fixed within the contact-receiving cavity for engaging the adjacent mating post contacts, including a pair of opposed resilient arms for contacting each of the adjacent mating post contacts, each of the arms of the pair adapted to engage the same mating post contact such that each mating post contact is engaged by the shunt contact at two points.

6. A low profile shunt connector assembly as set forth in claim 5, wherein the insulative housing further includes a bottom wall opposite the contact-receiving cavity formed with a through hole through which the mating post contact enters and with which the contact-receiving cavity communicates.

7. A low profile shunt connector assembly as set forth in claim 6, wherein each resilient arm includes a rounded contact portion formed thereon for engagement with the mating post contact.

8. A low profile shunt connector assembly as set forth in claim 7, wherein each rounded contact portion is located along each resilient arm near a distal end thereof.

9. A low profile shunt connector assembly as set forth in claim 7, wherein each rounded contact portion is located along each resilient arm approximately the same distance from top and bottom surfaces of the housing whereby the shunt contact is adapted to engage the mating post contacts independent of the orientation of the housing.

10. A low profile shunt connector assembly for engaging adjacent mating post contacts comprising:

an insulative housing defining a contact-receiving cavity;

an integrally formed conductive shunt contact received and fixed within the contact-receiving cavity for engaging the adjacent mating post contacts, including a pair of resilient arms adapted for contacting each of the adjacent mating post contacts, each of the arms of the pair including a rounded contact portion formed thereon for engagement with the same mating post contact wherein each rounded contact portion is located along each resilient arm such that the shunt contact is adapted to engage the mating post contacts independent of the orientation of the housing.

11. A low profile shunt for engaging adjacent mating post contacts comprising:

an integrally formed conductive shunt contact including a pair of resilient arms adapted for contacting each of the adjacent mating post contacts, each of the arms of the pair including a rounded contact portion formed thereon for engagement with the same mating post contact wherein each rounded contact portion is located along each resilient arm such that the shunt contact is adapted to engage the mating post contacts independent of its orientation.

* * * * *